US005614477A

United States Patent [19]

Kompan et al.

[11] Patent Number: 5,614,477

[45] Date of Patent: Mar. 25, 1997

[54] ANTI-FRICTION ADDITIVE AND METHOD FOR USING SAME

[76] Inventors: Vladimir Kompan, 1509 Landwehr Rd., Northbrook, Ill. 60062; Vitaly Slobodsky, 4003 Amalfi Dr., Glenview, Ill. 60025

[21] Appl. No.: 524,783

[22] Filed: Sep. 7, 1995

[51] Int. Cl.[6] ..... C10M 125/02

[52] U.S. Cl. ..... 508/13; 508/105; 508/109; 508/123

[58] Field of Search ..... 252/29, 30

[56] References Cited

U.S. PATENT DOCUMENTS

| | | | |
|---|---|---|---|
| Re. 29,285 | 6/1977 | Christini et al. | 428/426 |
| 3,422,032 | 1/1969 | Figiel et al. | 252/29 |
| 3,600,201 | 8/1971 | Alessi | 106/1 |
| 3,663,475 | 5/1972 | Figiel | 252/309 |
| 3,713,796 | 1/1973 | Valerio et al. | 51/298 |
| 3,915,716 | 10/1975 | Haack | 106/1 |
| 3,936,577 | 2/1976 | Christini et al. | 428/426 |
| 4,055,503 | 10/1977 | Anselment et al. | 252/29 |
| 4,345,798 | 8/1982 | Cortes | 308/160 |
| 4,411,672 | 10/1983 | Ishizuka | 51/309 |
| 4,540,636 | 9/1985 | MacIver et al. | 428/610 |
| 4,554,208 | 11/1985 | MacIver et al. | 428/332 |
| 4,618,505 | 10/1986 | MacIver et al. | 427/38 |
| 4,695,321 | 9/1987 | Akashi et al. | 75/243 |
| 4,802,539 | 2/1989 | Hall et al. | 175/329 |
| 4,828,728 | 5/1989 | Dimigen et al. | 252/12 |
| 4,960,643 | 10/1990 | Lemelson | 252/29 |
| 4,962,519 | 10/1990 | Upadhya | 38/133 |
| 4,990,372 | 2/1991 | Sunder et al. | 427/237 |
| 5,158,695 | 10/1992 | Yashchenko et al. | 252/30 |
| 5,183,602 | 2/1993 | Raj et al. | 252/587 |
| 5,198,285 | 3/1993 | Arai et al. | 428/216 |
| 5,215,942 | 6/1993 | MacKenzie et al. | 501/12 |
| 5,279,750 | 1/1994 | Hanano | 252/29 |
| 5,384,195 | 1/1995 | Bachmann et al. | 428/408 |

*Primary Examiner*—Ellen M. McAvoy
*Attorney, Agent, or Firm*—Dick and Harris

[57] ABSTRACT

A mixture of graphite and diamond particles is suspended in a liquid. The mixture is applied between relatively moving metal surfaces. The diamond particles subsequently become embedded in the surface of the metal. The surface treatment and embedding by the diamond particles thereby increases the lubricity of the moving surfaces.

17 Claims, 1 Drawing Sheet

ANTI-FRICTION ADDITIVE AND METHOD FOR USING SAME

BACKGROUND OF THE INVENTION

The present invention relates to the field of coatings and surface treatments for objects, which objects may be fabricated from metals, polymers, ceramics, glass, or composites thereof.

It is often desirable to improve the durability, wear resistance, surface hardness, and so on, of objects, such as gears, bearings, and other mechanical components, without having to resort to a change in the basic material from which the object is generally formed or fabricated. Such a change may often result in the unnecessary usage of expensive, rare, or difficult-to-work-with materials, and increased manufacturing effort and cost necessary to produce the particular object.

Wear of the surface of an object can be expressed in terms of three different processes which can occur. A surface can be damaged, such as by striking or impingement by a sharper or harder object, such that indentations, pits or holes are produced which are relatively large in comparison to the contour or texture of the surface. The surface can lose material as exposed portions of the particles making up the surface are broken, or entire particles are pulled away from the surface. Further, the particles which make up the interface between one layer and another can become separated, such that the layers become separated.

In order to improve the wear characteristics of a surface, the three described processes must be slowed. Damage to the surface is reduced by increasing hardness. Breakage and pull-away of particles from a surface is reduced by lubrication, or by increasing the surface lubricity of the object. Interface separation is reduced by using composite structures to alter the electrostatic characteristics of the materials making up the interface.

The performance characteristics of a mechanical component can often be improved, or changed to have specific desired characteristics, through various treatments of the surface of the object, for example, by various combinations of heat treatment, possibly combined with working of the surface of the object. The performance characteristics of the object may also be affected by the addition of layers of other materials, such as by cladding or coating. Improving the surface hardness and wear resistance of certain mechanical components, such as gears or bearings, or increasing the edge retention or abrasiveness of a surface, such as for a cutting or drilling tool, through the coating or plating of the object with a layer of metal, or a layer of material including a metal, is known in the prior art.

One material which has proven to be a useful anti-friction material is particulate diamond. U.S. Pat. No. 5,158,695 to Yaschenko et al., for example, shows the use of particulate diamond material as an anti-friction material.

The Yaschenko patent describes a material which was stated to be used in machine components which are subjected to wear due to friction. The Yaschenko reference describes using bars made of antifriction material (structures fabricated from mainly sintered copper-based intermetallides with zinc and tin, with dispersed diamond powder) for rubbing-in. The Yaschenko reference also describes uses of the new antifriction material to make substantially wearless sliding bearings and bushingless internal combustion engines.

The size of the particulate diamond material employed in the Yaschenko patent was 0.1 micrometer. The particulate diamond material concentrations employed ranged from 5.0 to 50 percent of the overall mass of the antifriction material. The Yaschenko patent then compared the use of the particulate diamond material as an anti-friction additive material to molybdenum disulfide, graphite and molybdenum disulfide, and copper-tin-zinc-graphite-cubic boron nitride. In Yaschenko, it was proposed that the use of additive material containing the diamond particulate powder in a range of 5.0 to 50 percent mass resulted in a higher scoring strength than the additive materials without the diamond particulate. Furthermore, it was also concluded that diamond powder having a grain size less than 0. 1 micrometer was preferred in order to maintain reinforcement of the metal surface without obtaining an abrasiveness.

Such prior usage of diamond particulate material has, however, not achieved a significant improvement in the tribological, or anti-friction, properties between two surfaces because of the weak physical bond between the rubbing bar materials and the treated surface. The Yaschenko anti-friction material contains a soft metal, such as copper or tin, as the lubricating agent and the diamond particles are used as a reinforcing agent. Using the soft metal itself as the lubricating agent improves the friction process; the diamond reinforcing agent, in the material of the Yaschenko reference, simply improves the strength and life of the lubricating agent and does not directly act as a lubricating agent. In the prior art method of Yaschenko, a method is disclosed for increasing the lubricity of two sliding surfaces by placing diamond particle into a solid antifriction material, which is then applied, as a treatment (rubbing-in) bar or as a bushing or the like. In such a utilization, the diamond particles do not increase the lubricity of the relatively sliding surfaces. The diamond particles only assist in increasing the time that the lubricating agent (copper, tin, etc.) stays between the relatively sliding surfaces. The diamond particles do not work as a lubricating agent, since the particles do not have contact with the sliding surfaces, due to the presence of the solid lubricating agent.

Such prior art methods will not reduce the coefficient of friction of the relatively sliding surfaces. Further, such solid antifriction materials can have limited applications.

It is desirable to provide a treatment for surfaces which are configured for relative sliding movement, in which the material which is utilized for providing antifriction properties will achieve a good bonding or adherence to at least one of the relatively sliding surfaces.

This and other objects of the present invention will become apparent in light of the present Specification, Claims, and Figures.

SUMMARY OF THE INVENTION

The present invention comprises an anti-friction material for facilitating the reduction of dynamic friction between two juxtaposed surfaces moving relative to one another. The anti-friction material is comprised of a liquid-based lubricant and a solid composite material which is operatively suspended within and dispersed throughout the liquid based lubricant. The solid composite material includes as a component thereof particulate diamond material. The solid composite material is further operatively configured such that upon introduction of the solid-liquid combination between two moving surfaces, the solid composite material will, upon commencement of movement, initially superpolish at least one of the surfaces to enhance the smoothness of the surface. By "superpolishing," it is meant that the diamond particulate material will reduce the roughness of at least one or possibly both of the two juxtaposed surfaces to produce surface finishes as fine as 0.004 micron (μ) Ra or finer. After the initial superpolishing, the solid composite material substantially permanently associates itself with one of the surfaces in order to cooperate therewith, toward producing a condition of increased lubricity between the two surfaces.

In a preferred embodiment of the invention, the liquid based lubricant is an oil. The solid composite material preferably includes as components thereof an additive mixture of particulate diamond material and graphite powder.

The concentration of the particulate diamond material preferably is in the range of 0.05% to 0.005% by weight, of the liquid-based lubricant. The size of the particulate diamond material preferably ranges from 0.1μ downwardly. The individual particles of the particulate diamond material are substantially round in shape. The concentration of the graphite powder ranges from 40% to 60% by weight of the solid part of the additive material.

In a preferred embodiment the solid composite material comprises particulate diamond material mixed with graphite powder in a ratio of 2:3 to 3:2.

The invention further comprises a process for the enhancement of lubricity of two relatively sliding surfaces in an apparatus comprising the steps of: a) introducing a liquid based lubricant between two relatively moving surfaces (e.g., putting crankcase oil into an i.c. engine); b) setting the two relatively moving surfaces into relative motion (e.g., starting the i.c. engine to get the pistons and other components moving and warming, and to get the oil circulating); c) introducing an additive material into the liquid based lubricant, the additive material including a mixture of diamond and graphite material; and d) continuing the relative motion of the two surfaces for a predetermined period of time, prior to placing a load on the apparatus.

The invention further comprises an alternative process for the enhancement of lubricity of two relatively moving surfaces comprising the steps of: a) mixing the particulate diamond material and graphite powder into a liquid based lubricant; b) introducing the anti-friction material into a system comprised of at least two juxtaposed surfaces which will be engaged in relative sliding movement; c) setting the at least two juxtaposed surfaces into relative sliding movement; and d) allowing the moving surfaces to embed the particulate material in one of the surfaces so as to decrease dynamic friction between the two relatively moving surfaces.

DETAILED DESCRIPTION OF THE INVENTION

Figure 1:
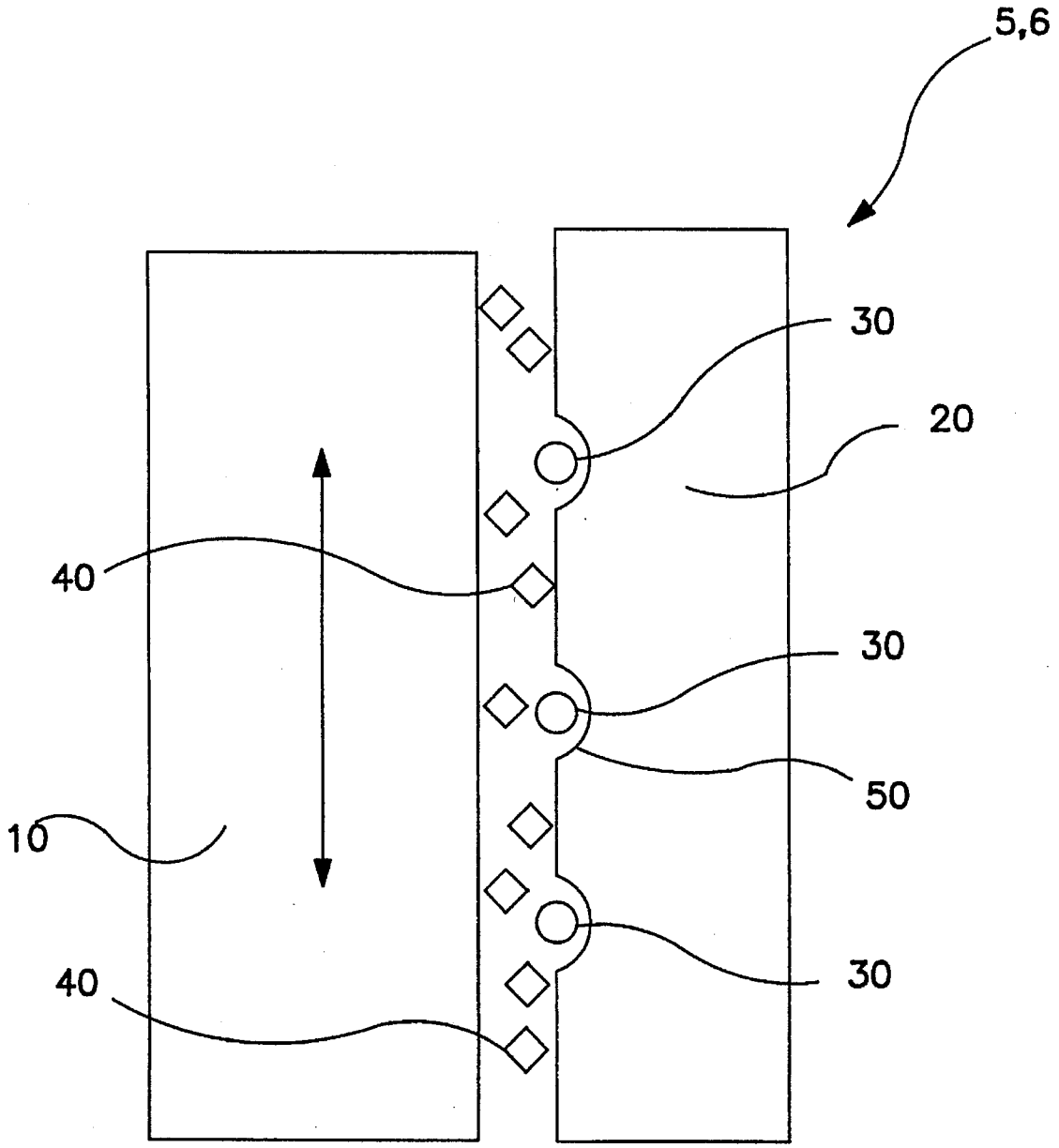
FIG. 1 is a highly simplified illustration, not to scale, of two surfaces arranged for relative sliding movement, showing the interaction of the diamond and graphite particles.

While this invention is susceptible of embodiment in many different forms, there is shown in the drawings and will be described in detail herein, one or more preferred embodiments, with the understanding that the present disclosure is to be considered as an exemplification of the principles of the invention, and is not intended to limit the invention to the embodiments illustrated.

The present invention will be described and illustrated being used in the environment of a reciprocating internal combustion engine. It is to be understood that the inventive lubricating material and method can be utilized, with equal effectiveness, in numerous other environments in which two relatively sliding (reciprocating, rotating or spinning) components are present.

A method for applying the lubricating material according to the present invention preferably involves adding the solid additive material (as described in detail herein) to a liquid lubricating material, which may already be present in the machine or device being lubricated (such as an i.c. engine), or which liquid lubricating material is being initially installed, or freshly replaced.

For example, in a new car (as a first load of oil) or in an old car (as part of an oil change), the engine is run until the operating temperature has been reached. After addition of the solid additive material to the oil, the engine should be run at idle for some time (e.g., 10–15 minutes) prior to placement of any significant load on the engine. This allows the solid additive material (in particular, the diamond particulate material) to smooth and polish the relatively moving surfaces within the engine, and provides time for the diamond particulate material to properly embed in the surface of the softer of the relatively moving surfaces. Different apparatus will require different amounts of time for the polishing and embedding processes to occur.

In an alternative method of using the present invention would be to prepare an amount of the lubricating liquid, by mixing into it an appropriate amount of the diamond-graphite powder, according to the percentages described herein, and agitating and/or heating the liquid, so as to place the particles of the powder into a substantially uniformly-dispersed suspension within the liquid, prior to introducing the liquid-powder combination into the device or apparatus, and then operating the apparatus, in order to enable the diamond particles to polish the various opposing surfaces, and then establish themselves within the softer of the opposing surfaces.

Two relatively sliding surfaces 5,6 (which, in a possible application of the invention may comprise an engine piston and engine cylinder) are shown in FIG. 1 as comprising a hard surface 10 (the piston ring), a soft surface 20 (cylinder liner), diamond particles 30, graphite particles 40, and a surface roller 50 (as described hereinafter). Although the relatively sliding surfaces 1 0, 20 are described as being a piston ring and an engine cylinder liner, it is contemplated that, in a preferred embodiment, the two relatively sliding surfaces be any two metal or non-metal surfaces or a combination of a metal and a non-metal surface (or even two non-metal surfaces having differing surface hardnesses) configured to have a relative sliding motion to one another with one of the surfaces preferably being approximately twice as hard as the other surface. One metal well-suited for taking advantage of the present invention, as the harder (metal) surface of two juxtaposed surfaces is chromium coated steel or cast iron, which may have a hardness of 60–70 Rc or higher.

The present invention is directed to a lubricating material for the surface treatment of metal or non-metal objects in order to produce increased lubricity, which, in turn, will result in a more wear-resistant surface. In particular, the additive material comprises two parts: a solid part substantially comprised of diamond particles 30 and graphite particles 40 as well as a liquid part (not illustrated, by present, filling the spaces between the moving surfaces), substantially comprised of a liquid-based lubricant. The diamond particles 30 are substantially round in shape.

The liquid-based lubricant may be an oil, in one preferred embodiment of the invention. Preferably, when the present invention is utilized in an automotive type environment, such as in an internal combustion engine, the oil will be an automotive engine grade oil, having a conventional range of viscosities. Such a material is preferred as the medium for the diamond powder because it disperses and suspends the diamond powder across the surfaces. The inventive process employs a diamond-graphite powder mixture, with the diamond and graphite components being provided in varying relative proportion, and suspended in a liquid-based lubricant such as oil. Graphite 40, or another additive material having a chemical nature similar to diamonds 30, is used as a thickening agent to disperse the diamond particulate powder 30 evenly throughout the lubricant. Also, the use of diamond material 30 will significantly reduce the potential of producing an abrasive surface. It is also believed that by using such diamond particulate material 30 which is substantially smaller than previously known in the art, the concentration of the diamond additive 30 which is utilized can be significantly lowered while still maintaining excellent anti-friction characteristics.

A significant aspect of the invention is that the diamond 30/graphite 40 surface treatment compound, as described, can be used as an additive to retroactively improve the anti-friction characteristics of relatively sliding surfaces 5,6 in previously manufactured existing metal or non-metal apparatus.

In the present invention, the diamond particles 30 contemplated to be used are in the size range of 0.1μ or smaller. The desired range of concentration of the diamond particulate 30, in the suspension, should be between 0.05% and 0.005%, inclusive, by weight of the liquid-based lubricant. The desired range of concentration of the graphite particles 40, in the suspension, should form between 40% and 60%, inclusive, by weight, of the solid additive material. It is believed that concentrations of diamond particles 30 which are less than 0.005%, by weight of the lubricant, will reduce scoring strength, because not enough diamond particulate material 30 is embedded in the soft surface 20 to compensate for friction. It is also believed that concentrations of diamond particulate 30 higher than 0.05% will lead to increased incidence and/or earlier onset of scoring because of excess particulate sliding between the surfaces 10, 20, which will effectively block the softer (20) of the two surfaces 10, 20 and not allow impregnation of the diamond particulate into the softer surface 20. If concentrations of diamond particles 30 lower than 0.005% are used, it is believed that the number of particles embedded would not be sufficient to meaningfully reduce friction and increase lubricity. A preferred concentration of additive, for general (heavy) usage, is 0.05% diamond particles 30 by weight of the lubricant.

The surface configuration of the diamond particles 30 is also important to the process. The particles should have a rounded or egg-shaped configuration, without sharp contours. This will reduce the likelihood of the diamond particles 30 acting as an abrasive in an undesired or uncontrolled manner. One known method of manufacture to obtain such rounded diamonds, particularly ones of 0.1μ or smaller, is to crush coarse diamond particles (100μ or so) and heat treat the crushed material. Sharp edge graphitization causes any sharp edges to round off, leaving egg-shaped diamond particles 30.

As the nominal size of the diamond particles 30 decreases, the cost of manufacture increases. As a result, at the present time, it is believed that 0.01μ nominally-sized particles are the smallest that are practicable to obtain, for use in the surface treatment processes of the present invention.

Current diamond particle manufacturing techniques do not permit the manufacture of particles of just one single specific size in a batch. Instead, the particles in a given batch will cover a range of sizes, for example, from 0.02μ to 0.05μ. There are well-known techniques, however, for influencing the general distribution of particles of different sizes within the specified range for a given batch, for example, to make most of the particles tend toward the large or small end of the range. Such techniques may involve variations in the processing time, etc. Furthermore, once a given batch of particles is manufactured, current manufacturing techniques are not capable of separating the batch into its separate component sizes, when the high and low ends of the range are close together, as in the above example. Accordingly, a given batch of particles will be nominally identified by the size of the predominate particle size which is present. For example, a batch nominally indicated as 0.05μ, may have the majority of particles in a narrow range between 0.04μ to 0.06μ. An absolute maximum particle size may be specified, which may be required to not be exceeded for a particular application.

Further, the rounded diamond particles 30, together with the graphite particles 40, are believed to act as surface rollers 50 which produce increased lubricity which is further believed to be beneficial in increasing surface wear resistance. The "rollers" are believed to reduce friction, by rotating under the influence of forces exerted by the boundary layer of lubricating liquid from the opposed relatively moving surface, or possibly in some circumstances, the force exerted by direct contact from the opposed relatively moving surface.

It is not only the diamond particle material which contributes to the effectiveness of the present invention and increases the lubricity of the relatively moving surfaces. An additional solid material is used. The additional additive material should be of a similar chemical type as the diamond particulate material in order to minimize the effects of any chemical reactions with the diamond particulate material or the sliding surfaces. The additional additive material should have a hardness of up to 3 (Moh's Scale) and have a specific gravity of up to 2.5 to provide suitable properties as a thickening agent. Graphite, for example, would be a suitable material for an additional additive material, having a specific gravity of 2.2 and a hardness on the Moh's Scale of 1.5. In addition the particles of the additional solid material should be within approximately one-half an order of magnitude of size as the diamond particle material, to assist in maintaining substantially uniform dispersion of the diamond particle material through the additive material, and prevent relative settling of the diamond particles relative to the graphite particles. That is, for diamond particles of a nominal size of 0.1μ maximum, graphite particles of up to 0.5μ could potentially be used. Of course, due to the much softer nature of the graphite particles, if graphite particles of larger size than the diamond particles are used and become caught between or against closely placed opposed moving surfaces, the large graphite particles will rapidly be broken down into smaller sized particles.

Another alternative way to disperse the diamond graphite additive in the liquid solution is by imputing an electro-repulsive charge on the surface of each of the particles, diamond or graphite, in the solid additive mixture. Charging the additive particles, will change the pH of the additive material and consequently the particles will repel one another. Such charging is possible only with a non-conductive material such as diamond. It is known that the metal components, in, for example, a motor, will acquire a charge, especially during operation. By advantageously charging the additive particles with a like charge, the metal surfaces will impart a uniform repelling force on all the additive particles, thus aiding in maintaining the uniformity of the dispersion. Of course, the repulsive force cannot overcome the mechanical forces generated during operation of the device which mechanical forces cause the embedding of the diamond particles into the softer surface.

This invention is suitable for use in devices made of most, if not all, machine grade metals. One of the materials which can be advantageously lubricated by the present invention is chromium coated steel or cast iron. This invention may also be used in environments wherein one or more of the relatively moving surfaces is fabricated from a non-metallic material such as ceramic or plastic.

In a preferred embodiment of the invention, the solid additive material is comprised of diamond particles 30 and graphite particles 40 mixed in a ratio of 2:3 to 3:2. If the graphite is less than 40% of the additive by weight then the dispersion of diamond particulate material may become non-uniform throughout the additive. If the amount of graphite used is greater than 60% by weight of the additive, it is believed that adequate charging of diamond particles into the softer surface will be prevented.

The diamond-graphite additive material is to be carried by, but not embedded within, a lubricating medium. The selection of the proper lubricant medium is vital to the effectiveness of the invention. The type of lubricant which is used in a given application depends on the load being born between the relatively moving components, the relative speed of the moving components, and the ambient temperature. The most common characteristics for selecting the proper lubricant are viscosity and load-carrying ability. In addition the desired nature of the lubricating layer must considered (full film, mixed film, boundary film). The mixed film and boundary film operations may be characterized as partial metal-to-metal contact between relatively sliding surfaces with a thin, discontinuous or intermittently present, film of lubricant between the surfaces. Full-film lubrication provides for the complete and substantially continuous physical separation of the relatively sliding surfaces by the lubricating material. The degree of film development is dependent upon, at least in part, the relative speeds of the relatively sliding surfaces. A mixed-film layer requires greater relative speeds (e,g., 10 feet per minute relative speed or greater) than a boundary-film layer (used for very slow speeds). A full-film layer requires greater relative speeds than a mixed-film layer (e.g., 25 feet per minute or greater).

In accordance with the present invention, the surface treatment diamond additive material is used with liquid lubricant, because semisolid and solid lubricants would not provide rapid, even distribution of the solid additive material over sliding surfaces. For the purposes of the present invention, the most appropriate lubricant for a given application, has been determined to be that liquid based lubricant, having the lowest viscosity, which will provide unbroken (i.e., full film) lubrication between the relatively sliding surfaces. Higher viscosity semi-liquid or semi-solid lubricants typically could not effectively spread the solid additive material over the sliding surfaces, due to the internal friction of such higher viscosity lubricants, or would require much more energy input than could be provided in the particular application. Accordingly, depending upon the conditions (load, speed and temperature conditions) of the specific application, the most appropriate liquid lubricant could be water or alcohol (for extremely light loads, low speeds, and low temperatures), machining oils, or other known lubricating oils. In the environment of the described application of an internal combustion engine motor, oils of differing weights will be applicable. For example, under conditions of 1000 rpm, 120° F. and a relatively light load of approximately 100 psi, an oil having a weight of SAE 10 would be appropriate. For more rigorous conditions, such as an increase of temperature to 140° F. or an increase in load to, for example, 250 psi, an oil with a weight of SAE 20 would be appropriate. Of course, even greater loads, temperatures and/or speeds would require heavier weight oils (e.g., for high loads at 300° F., or more, an oil having a viscosity of 1220 centistokes would be appropriate).

High efficiency of the surface treatment can be achieved when one of the sliding surfaces (for example, an engine piston ring 10) is at least twice as hard than that of the other sliding surface (for example, an engine cylinder liner). If the difference in hardness is less than a factor of 2 between the two surfaces, the ability to increase the lubricity of the surface will be lessened because fewer diamond particles 30 will be impregnated into the softer surface 20.

Round diamond particulate 30 having a size of 0.1μ will be applied to the surfaces 10, 20 at the beginning of the friction process in order to superpolish the sliding surfaces. This step is necessary to improve the contact between the sliding surfaces 10, 20 and to initially reduce the potential for scoring. By contact, it is meant (in view of the scale at which the lubricating phenomena are taking place) both direct physical contact and/or contact between opposing boundary layers of lubricating fluid on the opposing surfaces.

Graphite particles 40 (specific gravity—2.2, Moh's hardness—1.5), having a chemical nature similar to diamond particles 30, are used as a thickening agent to evenly disperse the particulate diamond within the additive material and onto the sliding surfaces 10, 20. The graphite-diamond additive material is suspended within the liquid lubricant, such as oil, in order to spread the additive material uniformly and thinly over the sliding surfaces 10, 20 and to keep the diamond particulate 30 from conglomerating. The liquid lubricant also has a viscosity which will provide an unbroken film of the diamond additive and liquid lubricant between the sliding surfaces.

After superpolishing and positioning the sliding surfaces in close contact, the softer surface 20 (for example, the engine cylinder liner) is embedded with diamond particulate 30 by the harder surface 10 (for example the piston ring). This treatment of the sliding surfaces 10, 20 provides a thin layer of free moving diamond 30 in the soft surface 20. The freely rotating diamond particulate acts as "rollers" 50, which then functions as a sliding surface to increase lubricity and, in the process, does not score the harder surface 10 in the process. An additional advantage of the present invention over known lubrication treatment materials (such as SLICK 50®) is that once the diamond particles 30 have become embedded, they will remain substantially indefinitely and typically will not need to be replaced, for the average useful life span of an automobile engine, for example, unlike such other treatments, which must be repeated regularly.

The present invention does not rely, unlike the prior art, upon "rigidly held" diamond particles; rather, by using round free-rolling diamond particles, the lubricity of the surfaces can be increased and maintained for substantially longer periods of time than previous prior art inventions. It is believed that the described diamond-graphite surface treatment provides higher scoring resistance of the sliding surfaces 10, 20 due to the diamond particulate 30 (after superabrasive polishing of the sliding surfaces) acting as a free rotating bearing 50. The prior art does not disclose the use of low concentrations of diamond particulate 30 in order to achieve higher scoring strengths. The scoring strength of the present invention was tested on a friction machine having a pin which was rotated on a V-block surface. The pin was constructed of chromium metal SAE 3135 having a hardness of 71 Rc (Rockwell). The V-block was constructed of AISI 1137 having a hardness of 20–24 HRc. The scoring strength was determined as the maximum loading pressure that when applied to the rotating pin would cause the pin to stop rotating or break. The maximum loading pressure for the V-block friction machine was 4500 lbs. Prior to beginning the tests, the inventive additive material in oil was applied to the surface of the V-block friction machine before rotating the pin. The test results are presented in the following table:

TABLE I

| | Ingredients, mass % | | | |
|---|---|---|---|---|
| Sample No. | Diamond | Graphite | Oil | Scoring strength (lbs) |
| Prototype (prior art)* | 30 | N/A | N/A | 1250 |
| 1 | 0.05 | 0.03 | 99.92 | 4200 |
| 2 | 0.023 | 0.011 | 99.966 | No failure up to 4500 lbs and over |
| 3 | 0.005 | 0.002 | 99.993 | 2100 |

*Solid sintered bearing element having diamond mixed in.

Situations in which the present invention may be advantageously employed can be divided, generally, into three broad classes: light, medium and heavy, with the determining factors being loading, speed of the relatively moving surfaces, and temperature. The formulations which are believed to be appropriate for each of these three classes are as follows:

TABLE II

| | Concentration, % | | Relative | | |
|---|---|---|---|---|---|
| | Diamond by weight of | Graphite by weight of | Proportion Diamond to | Particle Size | |
| Usage | liquid | additive | Graphite | Diamond | Graphite |
| light (approx. 120° F./ 100 psi) | 0.005 | 40 | 3/2 | 0.1μ | 0.4μ |
| medium (approx. 140° F./ 250 psi) | 0.025 | 50 | 1/1 | 0.1μ | 0.4μ |
| heavy (approx. up to 300° F./ 500 psi) | 0.05 | 60 | 2/3 | 0.1μ | 0.4μ |

The temperatures and pressures for each of the classifications in Table II provided above are to be considered as general guidelines. For example, a "medium" usage may have somewhat higher temperature, and somewhat lower pressure, etc. The "heavy" classification of Table II above is for conditions less rigorous than 300° F. and 500psi. For conditions more rigorous than that, it has been determined that an optimum increase in lubricity and scoring strength is achieved through a reduction in the diamond powder in concentration, approaching that employed in the "medium" classification.

The primary objective of using the inventive diamond surface treatment additive material is the reduction of wear between two relatively sliding surfaces through increased lubricity. Worn out or insufficiently polished surfaces lead to the relatively sliding surfaces not being in full contact with one another, and so the inventive diamond additive material, it is believed, will provide additional polishing, and improve contact between the relatively sliding surfaces. If the surfaces are worn out, the inventive diamond additive material will substantially curtail additional wear of the sliding surfaces. The efficiency of the diamond additive material will depend upon the shape or design of the sliding surfaces.

It is further believed that as an added benefit, motors operating with the present inventive lubricating system, will suffer fewer mechanical losses due to friction and thus have improved power output. Indeed, some preliminary testing of the surface treatment material of the present invention, employing i.c. outboard motors, has indicated an increase in output horsepower, on the order of approximately 15%.

The foregoing description and drawings merely serve to illustrate the invention and the invention is not limited thereto except insofar as the appended claims are so limited, as those skilled in the art who have the disclosure before them will be able to make modifications and variations therein without departing from the scope of the invention.

What is claimed is:

1. An anti-friction material for facilitating the reduction of dynamic friction between two juxtaposed surfaces moving relative to one another, said anti-friction material comprising the combination of:

a liquid based lubricant;

a solid additive material, operatively suspended within and dispersed throughout said liquid based lubricant, the solid additive material substantially includes as components thereof an additive mixture of particulate diamond material and graphite powder, and the solid additive material being operatively configured such that upon introduction of the combination between the two surfaces, the solid additive material will, upon commencement of said relative movement, initially polish at least one of the two surfaces to enhance the smoothness thereof and, thereafter, substantially permanently associates itself with one of the surfaces, to cooperate therewith, toward producing a condition of increased lubricity between the two surfaces.

2. The anti-friction material according to claim 1, wherein the liquid based lubricant is an oil.

3. The anti-friction material according to claim 1, wherein the concentration of the particulate diamond material amounts to 0.05% to 0.005% by weight of the liquid based lubricant.

4. The anti-friction material according to claim 1, wherein the individual particles of particulate diamond material are in a size range from 0.1 μ or smaller.

5. The anti-friction material according to claim 1, wherein the individual particles of the particulate diamond material are substantially round in shape.

6. The anti-friction material according to claim 1, wherein the concentration of the graphite powder amounts to 40% to 60% by weight of the solid part of the additive material.

7. The anti-friction material according to claim 1, wherein the solid additive material comprises particulate diamond material and graphite powder mixed in a ratio of 2:3 to 3:2 by weight.

8. A process for the enhancement of lubricity of two relatively sliding surfaces in an apparatus comprising the steps of:

introducing a liquid based lubricant between two juxtaposed surfaces configure for relative sliding movement;

setting the two juxtaposed surfaces into relative motion;

introducing an additive material into the liquid based lubricant, the additive material including a mixture of diamond and graphite material; and continuing the relative motion of the two surfaces for a predetermined period of time, prior to placing a load on the apparatus.

9. A process for the enhancement of lubricity of two relatively moving surfaces comprising the steps of:

mixing the particulate diamond material and graphite powder into a liquid based lubricant;

introducing the anti-friction material into a system comprised of at least two juxtaposed surfaces configured for relative sliding movement;

setting the at least two juxtaposed surfaces into relative sliding movement; and allowing the moving surfaces to embed the particulate material in one of the surfaces so as to decrease dynamic friction between the relatively moving surfaces.

10. The process according to claim 9 wherein the liquid based lubricant is periodically replaced into the system comprised of at least two relatively moving surfaces.

11. An anti-friction additive material for facilitating the reduction of dynamic friction between two juxtaposed surfaces moving relative to one another, for use with a liquid based lubricant, said anti-friction material comprising:

a mixture of diamond particulate material and graphite particulate material.

12. The anti-friction material according to claim 11, wherein the liquid based lubricant is an oil.

13. The anti-friction material according to claim 11, wherein the concentration of the particulate diamond material amounts to 0.05% to 0.005% by weight of the liquid based lubricant.

14. The anti-friction material according to claim 11, wherein the individual particles of particulate diamond material are in a size range from 0.1μ or smaller.

15. The anti-friction material according to claim 11, wherein the individual particles of the particulate diamond material are substantially round in shape.

16. The anti-friction material according to claim 11, wherein the concentration of the graphite powder amounts to 40% to 60% by weight of the solid part of the additive material.

17. The anti-friction material according to claim 11, wherein the solid additive material comprises particulate diamond material and graphite powder mixed in a ratio of 2:3 to 3:2 by weight.

* * * * *